US006000086A

United States Patent [19]

Tonks et al.

[11] Patent Number: 6,000,086

[45] Date of Patent: Dec. 14, 1999

[54] ESPRESSO TIP CLEANING BRUSH

[76] Inventors: Jesse M. Tonks, 3022 Eddy St., Marina, Calif. 93933; Cleveland E. Bledsoe, 17850 Northwood Pl., Salinas, Calif. 93907

[21] Appl. No.: 08/766,500

[22] Filed: Dec. 13, 1996

Related U.S. Application Data

[63] Continuation-in-part of application No. 08/634,863, Apr. 19, 1996, abandoned.

[51] Int. Cl.[6] ..... B08B 9/02

[52] U.S. Cl. ..... 15/104.04; 15/160; 15/176.6

[58] Field of Search ..... 15/104.04, 145, 15/160, 176.1, 176.6

[56] References Cited

U.S. PATENT DOCUMENTS 1,493,848 5/1924 Ebert ..... 15/176.6

4,862,549 9/1989 Criswell et al. ..... 15/104.04

5,566,416 10/1996 Karls ..... 15/104.04

*Primary Examiner*—Terrence Till

*Attorney, Agent, or Firm*—LaRiviere, Grubman & Payne, LLP

[57] ABSTRACT

The espresso tip cleaning brush has a permanent handle and a removable and replaceable brush body. The brush body can be of different brush stiffness and different sizes for different brushing needs. The brush body is a throw-away part while the brush handle is retained for use with other brush bodies. Each brush body is a hollow tube with the bristles pointed inwardly.

18 Claims, 1 Drawing Sheet

ESPRESSO TIP CLEANING BRUSH

This application is a continuation-in-part of application Ser. No. 08/634,863, filed Apr. 19, 1996, now abandoned.

TECHNICAL FIELD

The present invention relates to a brush and brush handle particularly configured for cleaning tips and nozzles such as an espresso coffee making machine tip cleaning brush.

BACKGROUND ART

Tubular nozzles, especially food and beverage dispensing nozzles need to be regularly cleaned. It is difficult to quickly and easily clean the exterior of such nozzles because of their configuration. Manual cleaning is usual because of the periodic needs of such cleaning. Furthermore, it is desirable to have a brush wherein the bristles are fresh, to avoid lack of cleanliness which might be caused by brushes with worn bristles.

SUMMARY OF INVENTION

In order to aid in the understanding of this invention, it can be stated in essentially summary form that it is directed to a manually engageable brush handle which has removably mounted therein a tubular brush. The tubular brush has interior bristles and is configured for the external cleaning of the nozzle or tip of an espresso coffee making machine.

It is thus a purpose and advantage of this invention to provide a cleaning brush for the tip of an espresso coffee machine so as to quickly, easily and properly clean the tip.

It is another purpose and advantage of this invention to provide an espresso tip cleaning brush which has a tubular brush which is demountable from the handle so that the tubular brush may be readily interchanged when worn and the handle is reused.

Other features of the present invention are disclosed or are apparent in the section entitled "Best Mode for Carrying Out the Invention."

BRIEF DESCRIPTION OF THE DRAWINGS

For a fuller understanding of the present invention, reference is made to the accompanying drawings taken in conjunction with the following detailed description of the Best Mode For Carrying Out The Invention. In the drawings.

Figure 1:
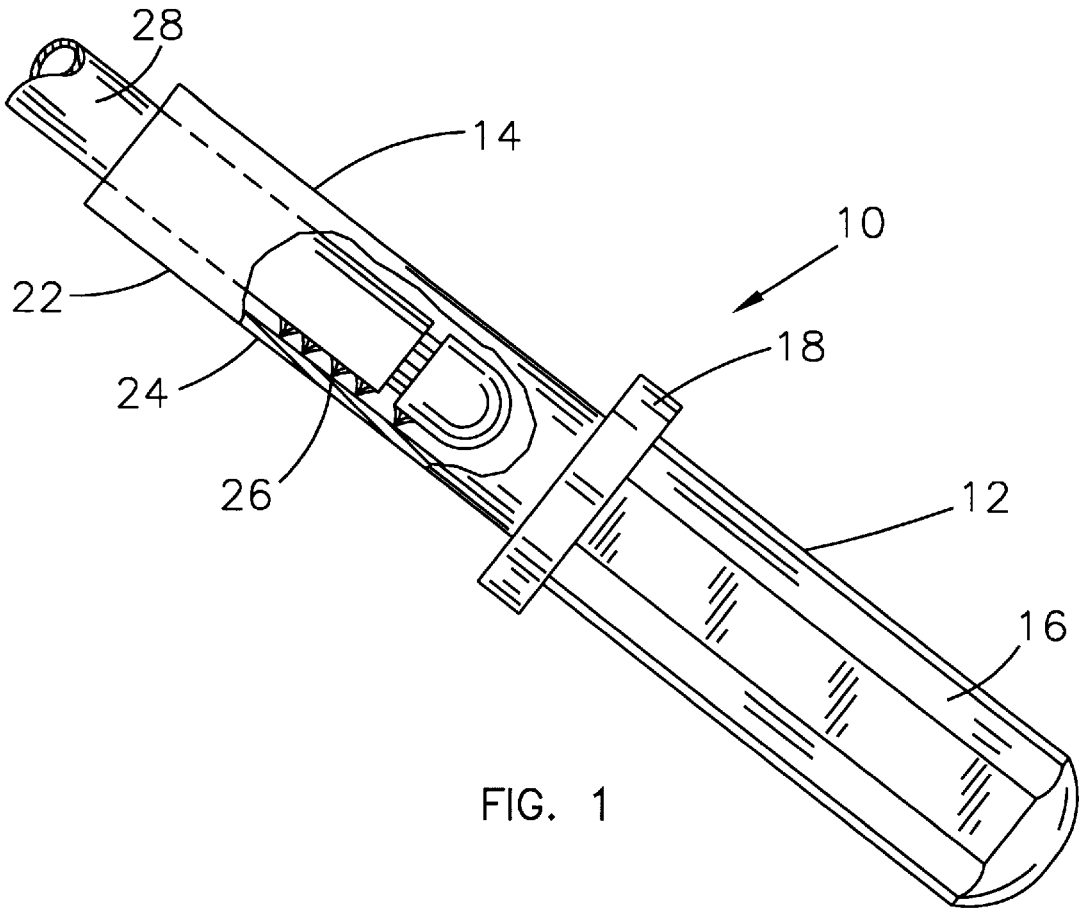
FIG. 1 is a side elevational view of the espresso tip cleaning brush of this invention, with parts broken away and parts taken in section, with the brush in association with an espresso tip, which is also broken away.

Reference numbers refer to the same or equivalent parts of the present invention throughout the several figures of the drawing.

BEST MODE FOR CARRYING OUT THE INVENTION

The espresso tip cleaning brush of this invention is generally indicated at 10 in FIG. 1. The brush 10 comprises handle 12 and brush body 14. The handle 12 is sized to be conveniently grasped in the hand. The handle 12 is preferably about 4 inches long and has a diameter of about 1¼ to 1½ inches for comfortable manual grasp. A plurality of longitudinal ribs, such as rib 16 is preferably provided on the handle. Furthermore, flange 18 is preferably provided at the forward end of the handle to aid in manual control of the brush 10. The handle 12 has a recess 20 in its forward end. The handle has a generally longitudinal central axis and this recess is a cylindrical surface about that axis.

Brush body 14 is in the form of a circular tube having a cylindrical outer wall 22 and a cylindrical inner wall 24. The inner wall has inwardly directed brush bristles 26. The cylindrical inner wall 24 defines the interior opening in the brush body and this interior opening is sized to receive espresso tip 28. The espresso tip 28 is a tip extending from a machine for producing potable coffee by the espresso method. The espresso tip needs exterior cleaning and it is for this purpose that the brush 10 is provided. The brush bristles 26 are sized in length and softness to receive the espresso tip therein and brush the exterior of the espresso tip.

Figure 2:
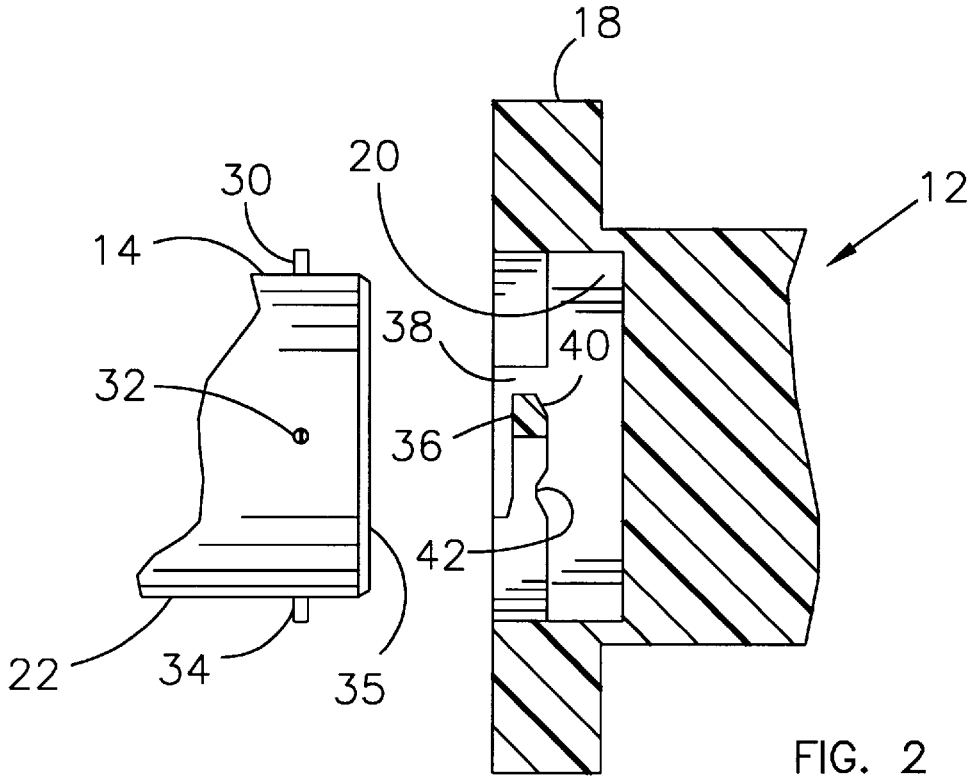
FIG. 2 is an enlarged longitudinal section through the handle of the espresso tip cleaning brush, in an exploded position with respect to an espresso tip cleaning brush, with both the handle and the brush broken away.

The brush body 14 is removably attached to the handle 12. The cylindrical outer wall 22 is sized to fit within recess 20. A plurality of pins extend outward from the cylindrical outer wall 22 at the handle end thereof. Three pins 30, 32 and 34 are shown in FIG. 2. There are preferably at least two of these pins, with three or four such pins being preferable. Three pins are shown in FIG. 2, but it is understood that these are arranged at 90° apart and there is a fourth one hidden from view.

There is structure provided within recess 20 for releaseably retaining the near end of the brush body 14 within the recess 20. This retaining means comprises a plurality of resilient fingers, one of which is seen at 36. When the brush body 14 is inserted into the handle 12, the pin 32 enters through the slot 38 at the end of finger 36. Insertion is complete when the near end 35 of the brush body engages in the bottom of the recess 20. At this point, the pin 32 is in line with the angular cam surface 40 at the end of finger 36. Rotation of the handle 12 in the clockwise direction with respect to the brush body 14, as seen from the near end of the handle, causes pin 32 to engage upon cam surface 40, bend forward the resilient finger 36 and permit rotation of the brush body until the pin 32 engages in notch 42. Once engaged in the notch, the brush 10 is ready for manual use.

The brush 10 is used for brushing the exterior of the espresso tip 28. The brush body can readily be removed and a new brush body installed. This procedure of changing brush bodies is accomplished whenever the bristles are worn out or bristles of different stiffness are desired. Removal is accomplished by counterclockwise rotation of the handle with respect to the brush body to release the brush body from its bayonet connection. The brush body can be a throw-away item so that it can be disposed of when the bristles are worn out. The brush handle is saved for use with another brush body. The new brush body may have the same or different character or stiffness of the bristles. Furthermore, the new brush body may have a different sized opening through the bristles so that espresso tips or similar devices of somewhat different size may be accommodated.

With this construction, the espresso tip cleaning brush provides a structure which can be easily manipulated to accomplish the cleaning task. The brush is equipped with a throw-away brush body. A new brush body can be quickly and easily installed in the brush handle. The new brush body may have a different size opening within the bristles or different bristles therein for selection depending on cleaning needs. The handle 12 is conventionally molded of thermoplastic synthetic polymer composition material of such characteristics that the resilient finger 36 can be sufficiently resilient to act as a detent for the releaseable attachment of the brush body. Furthermore, the brush body 14 is preferably made of thermoplastic synthetic polymer composition material so that it can be inexpensively made so that it can be thrown away when its service is complete. The brush bristles 26 within the brush body are also preferably thermoplastic synthetic polymer composition material, not only because such material is inexpensive but because it can be formulated and manufactured to create bristles of different selected stiffness.

While this invention has been described in its presently contemplated best mode, it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A brush, comprising:

a handle defining an axis and having an external surface which is sized and configured to be manually graspable, said handle having a forward end, said forward end of said handle having a recess therein;

a tubular brush body having an inner wall and an outer wall, said outer wall being sized and configured to be releasably inserted into said recess in said brush handle such that the brush body is removable from the handle for replacement of the brush body by a new brush body insertable into the handle, bristles made of synthetic polymer composition material being secured interiorly thereof, said bristles extending interiorly from said interior surface of said brush body, said brush body with said bristles being configured and sized to receive therein a structure to be brushed.

2. The brush of claim 1 wherein said handle is made of synthetic polymer composition material.

3. The brush of claim 2 wherein said brush body and said bristles are made of synthetic polymer composition material, said brush body being structured to be removable from said handle and replaced by a new brush body inserted into said handle.

4. The brush of claim 1 wherein said recess within said handle is concentric around said axis and is a cylindrical recess, said tubular brush body being sized to fit within said cylindrical recess.

5. The brush of claim 4 wherein there is releaseable interengagement means between said brush body within said recess in said handle so as to releaseably retain said brush body with respect to said handle.

6. The brush of claim 5 wherein said releaseable means within said recess comprises a resilient finger and there is a pin on said external surface of said brush body, said pin engaging said resilient finger when said brush body is retained in said handle.

7. The brush of claim 6 wherein said resilient finger has a detent notch therein and said pin rests in said detent notch when said brush body is engaged in said handle.

8. The brush of claim 7 wherein said handle is made of synthetic polymer composition material.

9. The brush of claim 8 wherein said brush body and said bristles are made of synthetic polymer composition material, said brush body being structured to be removable from said handle and replaced by a new brush body inserted into said handle.

10. The brush of claim 7 wherein said brush body and said bristles are made of synthetic polymer composition material, said brush body being structured to be removable from said handle and replaced by a new brush body inserted into said handle.

11. A brush, comprising:

an elongated handle defining a front end and a back end, said handle having an external surface which is configured and sized to be manually graspable by a user with his thumb adjacent said front end of said handle, said handle having a longitudinal axis and said external surface being substantially aligned with said longitudinal axis, a recess being formed in said front end of said handle, said recess being substantially a cylindrical surface around said axis, a resilient finger being disposed adjacent said recess;

a tubular brush body having an interior surface and an exterior wall, said exterior surface of said tubular brush body being sized to releasably engage in said recess in said handle, brush bristles being within said tubular brush body and extending from said interior surface inwardly with respect to said brush body so that said handle can be manipulated said bristles to clean a device when the device is inserted into said tubular brush body, said brush body being removable, disposable, and replaceable within said handle, said finger retaining said brush body within said recess.

12. The brush of claim 12 wherein said brush body is a cylindrical tube.

13. The brush of claim 11 wherein said brush body has a pin thereon and said pin is engaged by said resilient finger to releaseably retain said brush body with respect to said handle.

14. The brush of claim 13 wherein there is a detent notch in said resilient finger, said detent notch being engaged by said pin when said brush body is releaseably engaged in said handle.

15. The brush of claim 14 wherein said detent notch is in said resilient finger on the side away from said front end of said handle.

16. The brush of claim 15 wherein said brush body is a cylindrical tube.

17. The brush of claim 16 wherein said handle has an outwardly extending flange thereof adjacent said forward end of said handle.

18. The brush of claim 11 wherein said handle has an outwardly extending flange thereof adjacent said forward end of said handle.

* * * * *